US006749052B2

(12) United States Patent
Carmichael

(10) Patent No.: US 6,749,052 B2
(45) Date of Patent: Jun. 15, 2004

(54) ANTI-CHEATING DEVICE FOR A GAMING MACHINE

(75) Inventor: Tommy G. Carmichael, Tulsa, OK (US)

(73) Assignee: iGames Entertainment, Inc., Boca Raton, FL (US)

( * ) Notice: Subject to any disclaimer, the term of this patent is extended or adjusted under 35 U.S.C. 154(b) by 0 days.

(21) Appl. No.: 09/978,605

(22) Filed: Oct. 16, 2001

(65) Prior Publication Data

US 2002/0100659 A1 Aug. 1, 2002

Related U.S. Application Data

(60) Provisional application No. 60/241,811, filed on Oct. 19, 2000.

(51) Int. Cl.[7] ..... G07C 3/00; G07F 9/02

(52) U.S. Cl. ..... 194/201

(58) Field of Search ..... 194/201, 200, 194/202, 204; 250/559.04, 559.15, 559.43

(56) References Cited

U.S. PATENT DOCUMENTS

| | | | | |
|---|---|---|---|---|
| 2,237,132 A | * | 4/1941 | Christensen | 194/302 |
| 3,844,394 A | * | 10/1974 | Hale et al. | 194/201 |
| 3,998,309 A | * | 12/1976 | Mandas et al. | 194/203 |
| 4,105,105 A | | 8/1978 | Braum | |
| 4,749,074 A | | 6/1988 | Ueki et al. | |
| 5,531,309 A | | 7/1996 | Kloss et al. | 194/202 |
| 5,767,506 A | * | 6/1998 | Bell | 250/221 |
| 5,967,287 A | | 10/1999 | Cole | |
| 6,003,651 A | * | 12/1999 | Waller et al. | 194/202 |
| 6,029,891 A | | 2/2000 | Freeman et al. | |
| 6,179,704 B1 | | 1/2001 | Suzuki | 453/63 |

FOREIGN PATENT DOCUMENTS

| | | | |
|---|---|---|---|
| EP | 0 436 258 A2 | 12/1990 | G07F/9/02 |
| EP | 0 549 249 A2 | 12/1992 | G07F/3/02 |
| EP | 0 575 136 A1 | 6/1993 | G07D/1/00 |
| EP | 0.579.449 A2 * | 1/1994 | G07F/17/34 |
| FR | 2367324 | 10/1976 | G07F/1/04 |

* cited by examiner

*Primary Examiner*—Donald P. Walsh
*Assistant Examiner*—Mark J Beauchaine

(57) ABSTRACT

An anti-cheating device for a gaming machine which prevents or detects the insertion of a cheating device through the coin slot or a coin chute. In a first preferred embodiment, an emitter/detector assembly transmits and detects and energy beam cast across the cross section of the coin chute. The insertion of a cheating device through the coin chute disrupts the beam resulting in a "tilt" of the machine or an alarm. In another preferred embodiment, a coin director prevents access to the coin counter through the coin slot by an elongated cheating device, thereby preventing manipulation of the counter.

20 Claims, 9 Drawing Sheets

ANTI-CHEATING DEVICE FOR A GAMING MACHINE

CROSS REFERENCE TO RELATED APPLICATION

This application claims priority from copending U.S. provisional patent application Serial No. 60/241,811, filed Oct. 19, 2000, the disclosure of which is incorporated herein by reference.

BACKGROUND OF THE INVENTION

Field of the Invention

The present invention relates to anti-cheating devices for gaming machines. More particularly, but not by way of limitation, the present invention relates an anti-cheating device for a slot machine, or the like, which detects or prevents the entry of a cheating device.

Background of the Invention

Gaming machines such as slot machines, draw poker machines, bingo machines, and the like are prevalent in casinos around the world. Such machines deal primarily in cash, tend to accumulate rather large sums of cash before collections are made, and, since all of the money is not removed from a machine in service, theft is difficult to detect. Thus, these machines are prime targets for tampering.

The evolution of cheating devices has, thus far, kept pace with the evolution of gaming machines. Techniques and devices were developed for tampering with purely mechanical slot machines. Methods included the use of magnets, drilling or cutting holes in the enclosure of the machine, using counterfeit "slugs", or even a coin on a string. As gaming machine manufacturers replaced mechanical assemblies with electronic alternatives, cheating devices were developed to cheat these machines as well. For example, a generation of gaming machines employed mechanical devices to time the reels but used electronic circuitry to pay-out coins. A known cheating device used on this generation of machine would provide a contact closure causing the circuitry to continuously activate the feeder motor. The user of such a device could simply operate the feeder motor until the coin hopper was empty.

Over the past several years, gaming machine manufacturers have replaced the vast majority of mechanical components employed in such machines with electronic circuitry. Programmable circuits, especially microprocessor devices, have allowed manufacturers to incorporate a number of anti-cheating devices and methods which deter such cheating. For example, modern slot machines include a coin comparator which compares the magnetic signature of an inserted coin against the signature of a reference coin. Access to the coin counter is gained only if the compare is successful. If there is not a match, the inserted coin is directed to the coin return and the machine does not give a credit for the deposited coin. Such devices are effective in preventing a person from using counterfeit coins or slugs. A further example of an existing anti-tampering device is the optical coin counter used in the majority of modem slot machines. This device provides three LED's which emit light across a coin path to three detectors. After a coin has been successfully compared, it falls through the coin path, sequentially disrupting the light striking the detectors. If a coin does not properly break the beams (e.g., traveling in the wrong direction through the coin counter as would a coin on a string), the counter produces an output which "tilts" the slot machine thereby alerting casino workers and disabling the machine.

While these devices perform satisfactorily to prevent tampering in limited areas, they are wholly ineffective in discouraging cheating by the sophisticated thief using specially made cheating tools. Such tools are typically inserted either through the coin slot or through the coin chute and used to manipulate features internal to the gaming machine. For example, it is known that a tool may be formed from a thin elongated sheet of plastic which may be inserted in the coin slot. Without disclosing the mechanics of defeating the existing anti-cheating devices, it has been demonstrated that such a tool can be used to accumulate in excess of 40 credits per second on many slot machines. A user of such a tool can rapidly accumulate hundreds, or even thousands, of credits and then simply press the "cash out" button to receive cash from the machine.

In another example of sophisticated cheating, a tool is inserted through the coin chute to temporarily disable the coin detector on the feeder which pays out a jackpot. Such feeders attempt to feed a coin until a coin is detected or for several seconds if no coin is detected. Thus, with such a tool in place, a user will receive several coins for each coin the machine attempts to payout. With a modem slot machine, a person can accumulate credits by simply inserting coins and then, with a cheating tool in place, press the "cash out" button to receive several times the amount actually inserted in the machine. While most gaming machines are programmed to initiate a service call if too many consecutive attempts to feed a coin are unsuccessful, an experienced thief can receive as many as forty coins for each coin the machine attempts to pay out, without detection by the machine.

While a given cheating device may only be usable on a specific model of gaming machine, modifications may be made to create a similar tampering device for all known gaming machines. Thus, a thief armed with a relatively small assortment of tools can quickly cheat an array of machines, taking substantial amounts of cash in a relatively short period of time. Cheating tools tend to be relatively small and often formed mainly from transparent materials. An experienced thief can easily carry and use such tools with little risk of detection.

It is thus an object of the present invention to provide an anti-cheating device which prevents or detects the insertion of a cheating device through the coin slot of a gaming machine.

It is a further object of the present invention to provide an anti-cheating device for a gaming machine which prevents or detects the insertion of a cheating device through the coin chute.

It is still a further object of the present invention to provide an anti-cheating device for a gaming machine which may be easily incorporated into an existing machine.

SUMMARY OF THE INVENTION

The present invention provides an anti-cheating device for a gaming machine which satisfies the needs and alleviates the problems mentioned above. In a preferred embodiment, the anti-cheating device prevents or detects the insertion of a cheating device through the coin slot. Known cheating devices which successfully defeat both the coin comparator and the coin counter employ, by necessity, an elongated, substantially rigid foundation. Thus, the insertion of such a device may be prevented by providing a nonlinear coin path, or alternatively, such a device may be detected by sensing for the presence of such an elongated object in the coin path.

For the purposes of this invention, the terms "anti-cheating" and "anti-tampering" are used interchangeably as are the terms "cheat" or "cheating" and "tamper" or "tampering". The terms "cheat" or "cheating" and "tamper" or "tampering" are in used reference to the manipulation of a gaming machine to cause the machine to pay-out money either when no money is due to be paid out or in excess amounts when the machine attempts to legitimately pay-out money. The terms "anti-cheating" and "anti-tampering" refer to devices or methods for preventing cheating or tampering.

In another preferred embodiment, the anti-cheating device detects the presence of a cheating tool inserted through the coin chute by providing an array of emitters and detectors about the coin chute. Disruption of an energy beam emitted by the emitters and normally striking the detectors will, based on the machine owner's preference, result in one or more of: a "tilt" condition of the machine; an immediate flag of the machine for service; a disabling of the coin feeder; and/or an alarm. Sensing is automatically disabled as the machine properly feeds coins out the chute to avoid false indications of tampering.

Further objects, features, and advantages of the present invention will be apparent to those skilled in the art upon examining the accompanying drawings and upon reading the following description of the preferred embodiments.

DESCRIPTION OF THE PREFERRED EMBODIMENTS

Before explaining the present invention in detail, it is important to understand that the invention is not limited in its application to the details of the construction illustrated and the steps described herein. The invention is capable of other embodiments and of being practiced or carried out in a variety of ways. It is to be understood that the phraseology and terminology employed herein is for the purpose of description and not of limitation.

While the preferred embodiment of the inventive device is hereinafter shown and described as being incorporated in a slot machine, it should be understood that the invention is not so limited and is applicable to all gaming machines and, in fact, aspects of the invention are applicable to many types of coin operated devices.

Figure 1:
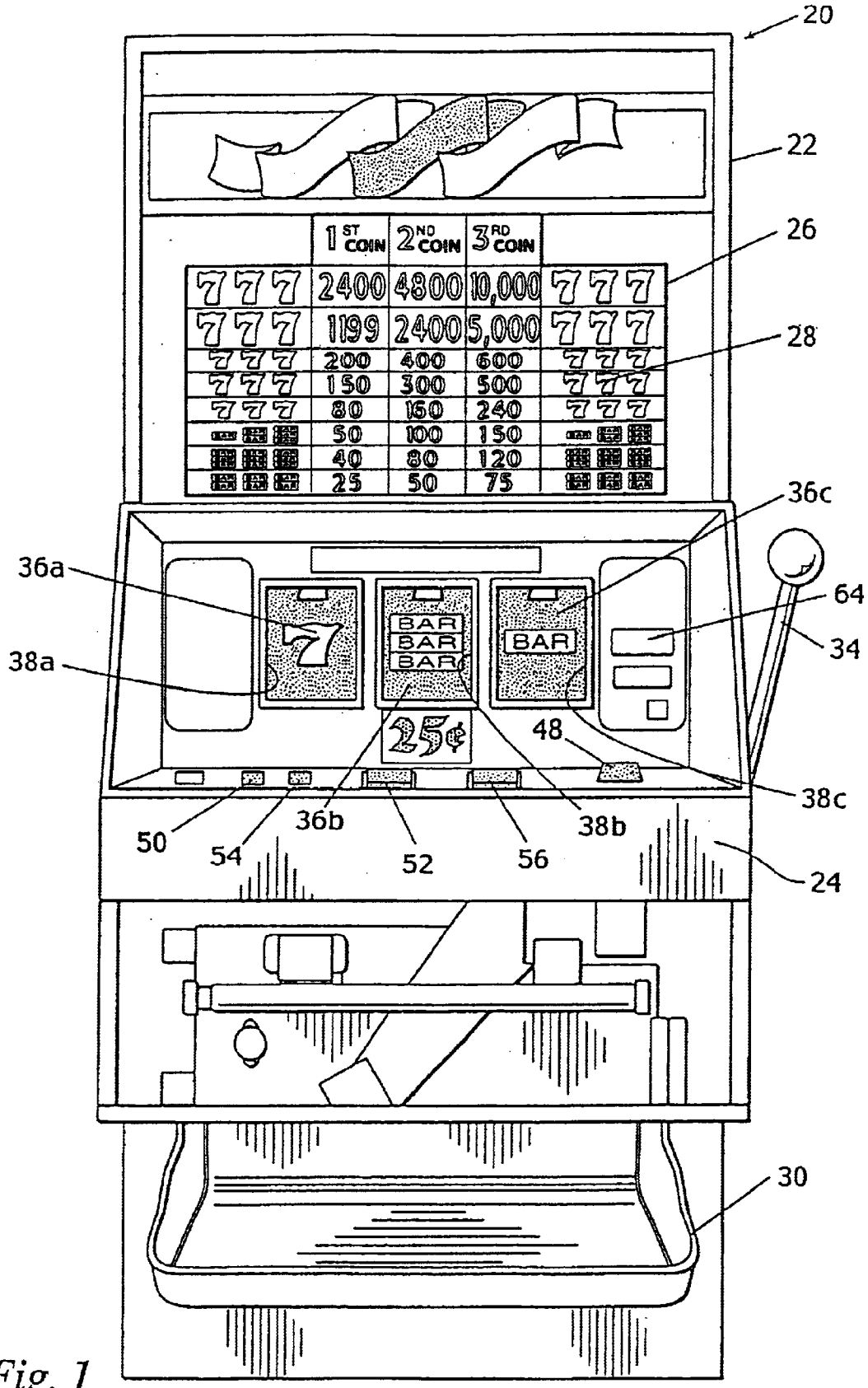
FIG. 1 provides a front view of a gaming machine wherein a preferred embodiment inventive anti-cheating device is incorporated in its general environment.

Referring now to the drawings, wherein like reference numerals indicate the same parts throughout the several views, a preferred embodiment of the inventive anti-cheating device is incorporated into a slot machine 20 as shown in FIG. 1. Preferably, slot machine 20 comprises: an outer enclosure 22 having a door 24; a top portion 26 whereon is displayed jackpot information 28, a coin tray 30 located beneath chute 32 (FIG. 2) for receiving coins paid out by machine 20; a handle 34 for activating a "play"; and reels 36*a–c* which show through corresponding window 38*a–c* in door 24.

Figure 2:
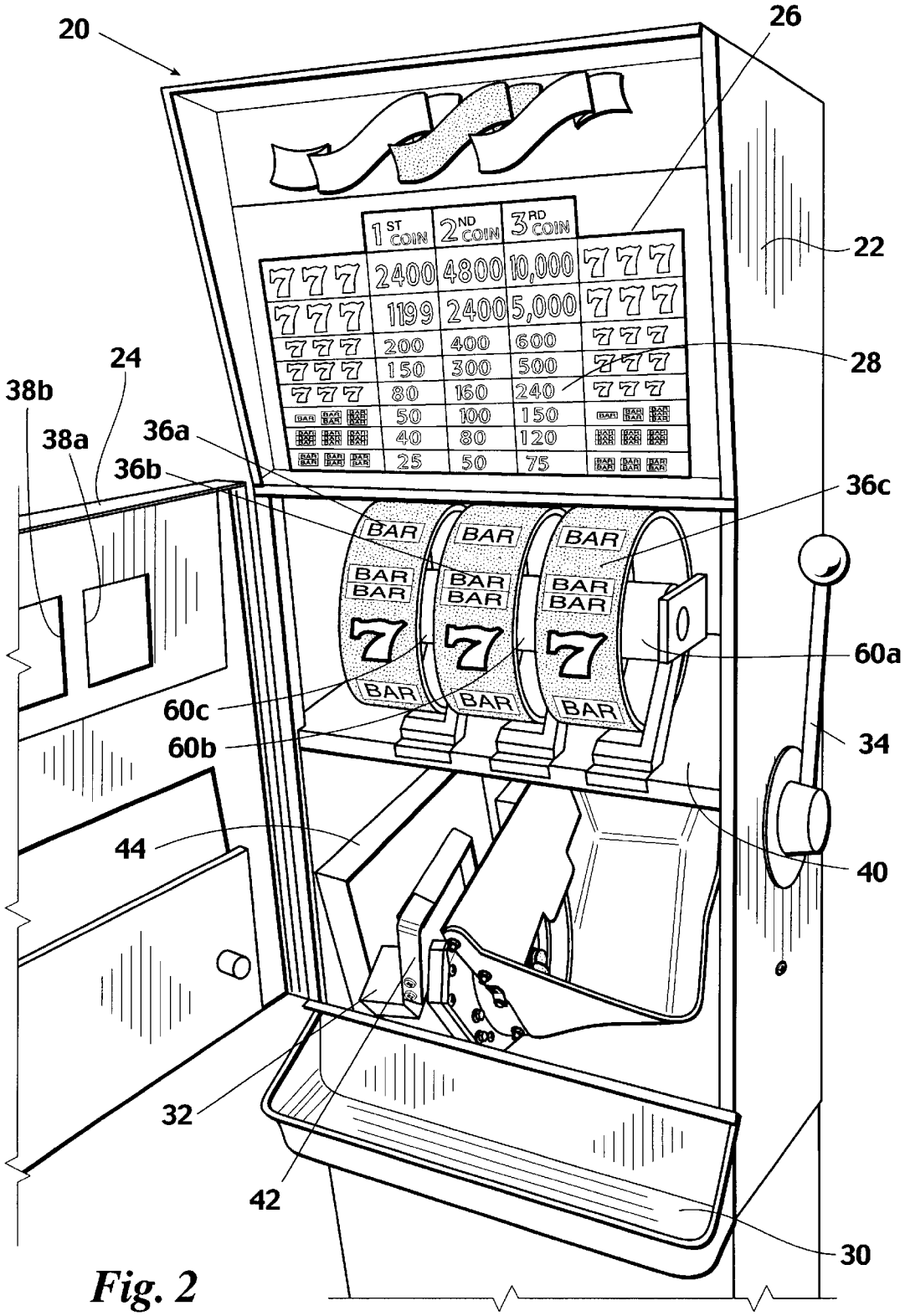
FIG. 2 provides a front internal view of a gaming machine.
Figure 11:
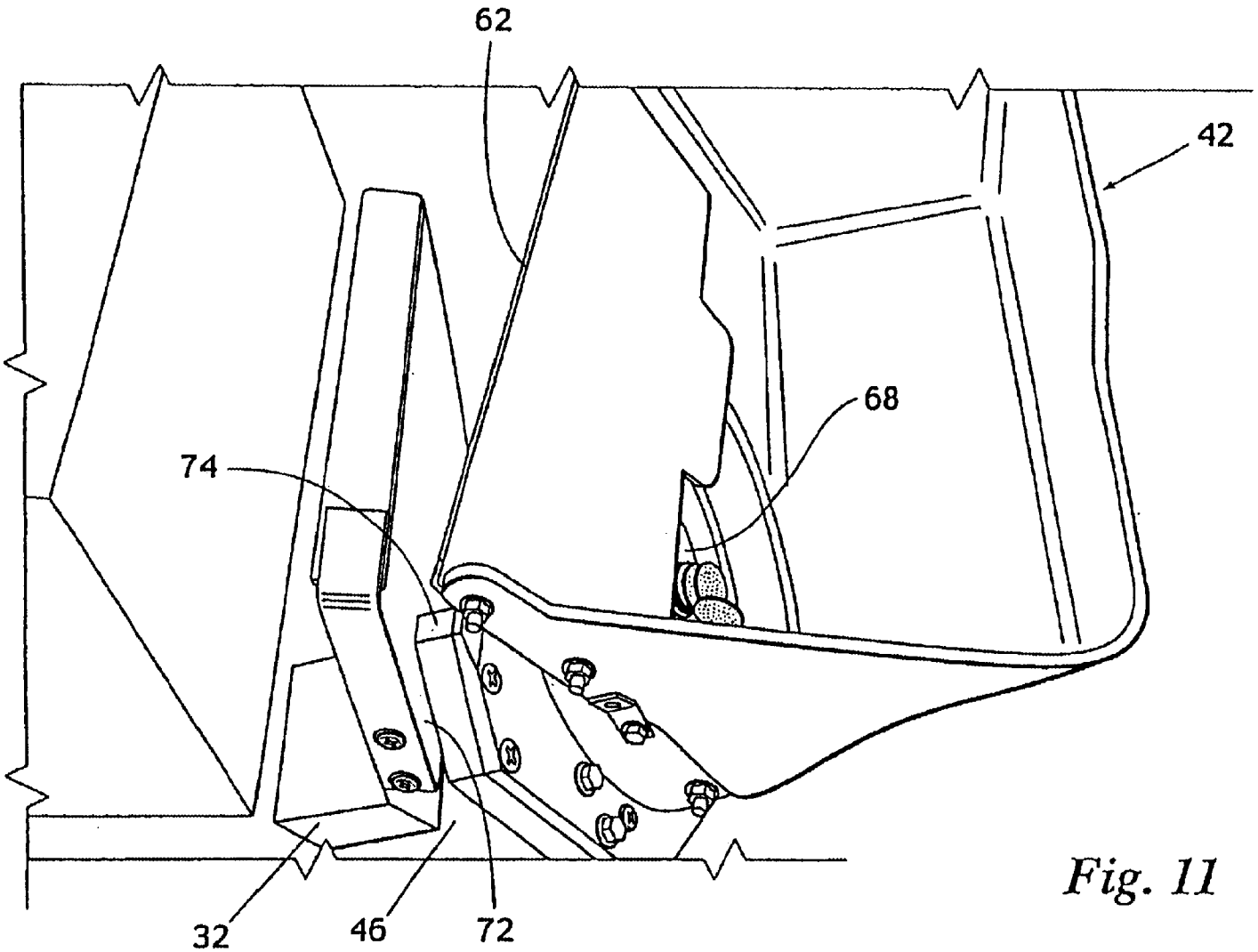
FIG. 11 provides a perspective view of a coin hopper and coin feeder employed in a gaming machine.

Continuing with FIG. 1 and with further reference to FIG. 2, enclosure 22 houses: shelf 40 which supports reels 36*a–c*; coin hopper/feeder assembly 42 for discharging coins through dispenser chute 32 and coin chute 132 (FIG. 3), into tray 30; and electronic circuit board assembly 44 which provides outputs to reel motors 60*a–c* to selectively spin reels 36*a–c* and coin feeder motor 46 (as best seen in FIG. 11), as well as inputs for buttons 50, 52, 54, and 56 on door 24, for a switch (not shown) operably connected to handle 34, for coin handler assembly 100 (FIG. 3) and from various tilt sensors. Shaft encoders (not shown) are in rotational communication with reels 36*a–c* and produce a signal received by circuit board assembly 44 whereby each reel 36*a–c* can be precisely stopped to display the portion of each reel 36*a–c* through windows 38*a–c*, respectively, as determined by circuit board assembly 44. If circuit board assembly 44 calls for a jackpot, reels 36*a–c* are stopped to correspond to a pay-out as indicated in the jackpot information 28 and the appropriate number of credits are displayed in window 64 on door 24.

To operate the machine, a user typically begins by dropping coins or tokens in coin slot 48. Next, the user pulls handle 34 to activate a "play". Upon pulling the handle, the circuitry on circuit board 44 determines where reels 36*a–c* should stop, enables power to reel motors 60*a–c*, and then one-by-one stops reels 36*a–c* at the predetermined position after a predetermined period of time. If a jackpot is indicated, circuit board 44 adds the appropriate number of credits to the number displayed in window 64. If credits are shown, the user may use credits in lieu of coins by pressing button 54 on door 24 or may play three credits and activate a play by pressing button 56. In addition, the a user may initiate a play by pressing button 52 rather than pulling handle 34.

Referring now to FIGS. 1 and 11, when desired, the user can convert credits to coins, by user pressing the "cash out" button 50 on door 24. Upon receipt of the signal from button 50, circuit board 44 enables electrical power to feeder motor 46 which rotates disk 68 to lift individual coins from hopper 62. As each coin nears the top of disk 68, the coin passes through an aperture (not shown), to coin detector 74 and through channel 72 before being discharged through chute 32. Circuit board assembly 44 (FIG. 2) counts each coin detected by detector 74 and disables power to feeder motor 46 when the appropriate number of coins have been discharged.

Figure 3:
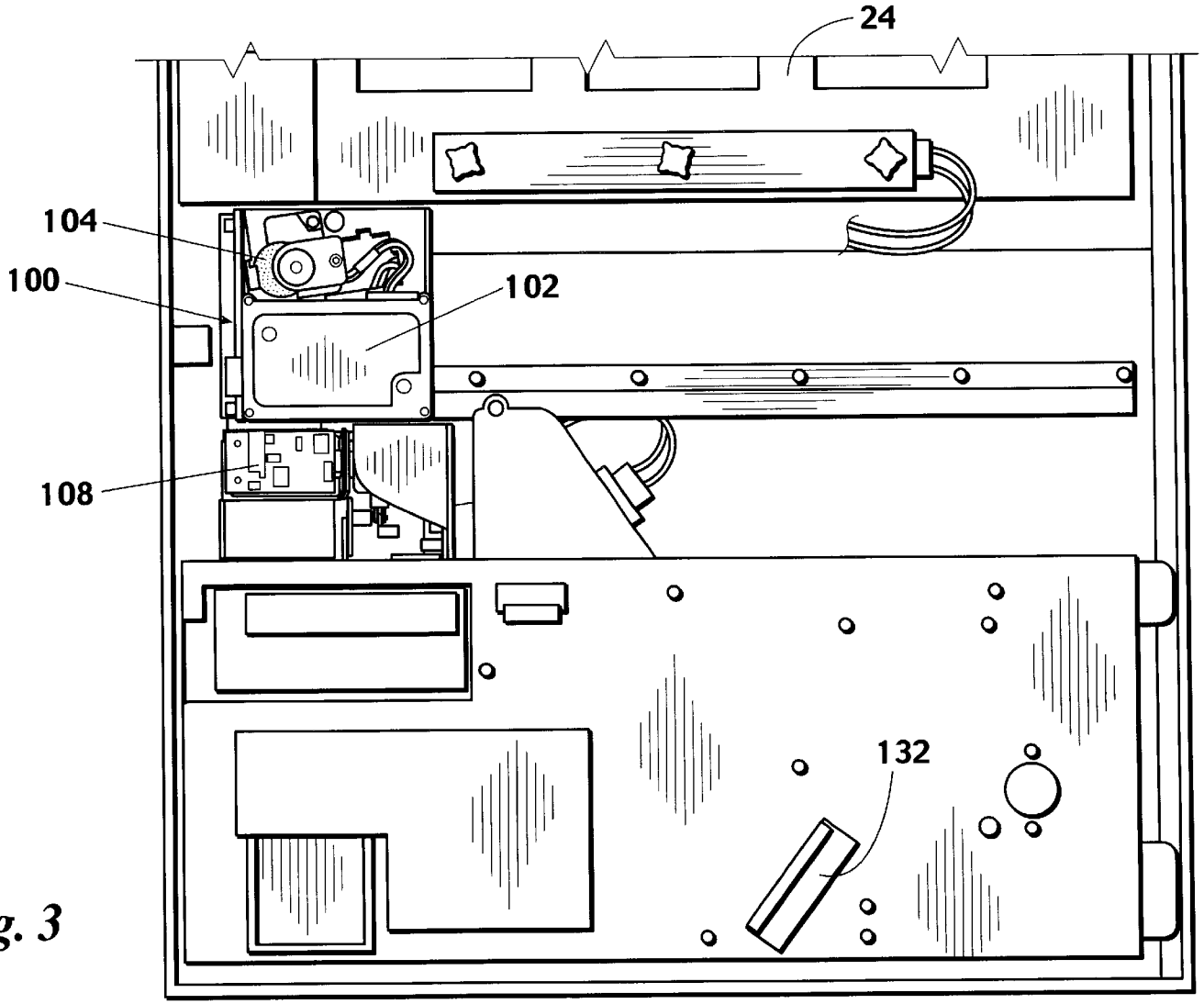
FIG. 3 provides a rear view of the door of a gaming machine having a coin handling assembly attached thereto.
Figure 4:
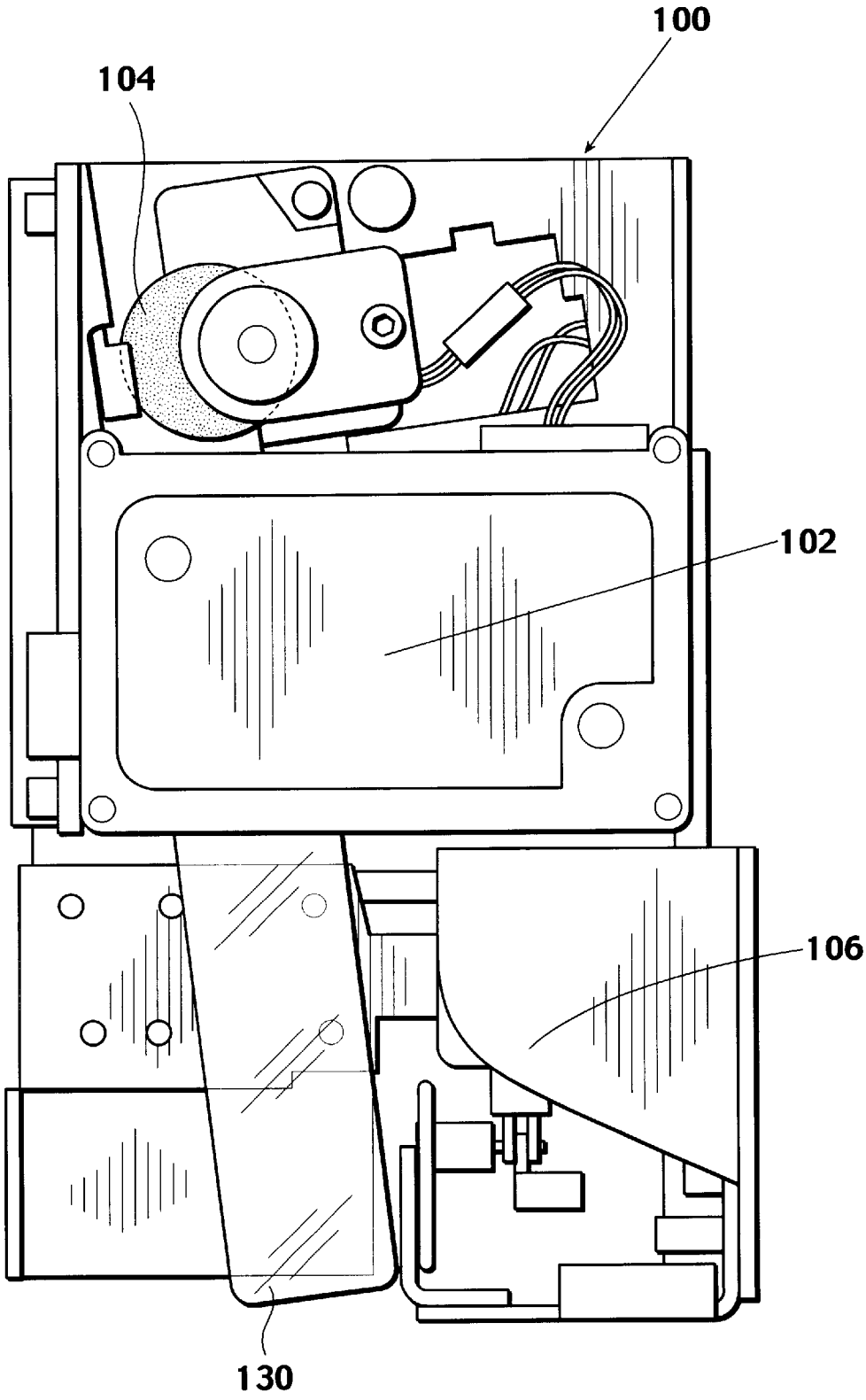
FIG. 4 provides a front view of a partially assembled coin handling assembly with a representative cheating tool inserted therein.

Referring now to FIGS. 3 and 4, coin handler 100 includes coin comparator, 102 which compares the magnetic signature of a reference coin 104 to an inserted coin. If there is a match, the inserted coin is allowed to continue down the coin path. If, on the other hand, the magnetic signatures do not match, the inserted coin is discharged out a coin return path 106. As a coin continues down the coin path, it passes through optical coin counter 108.

Figure 5:
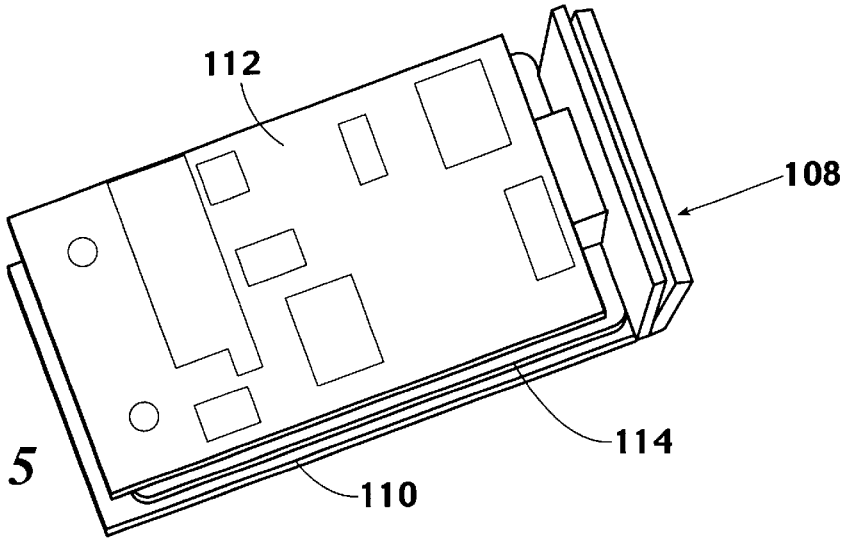
FIG. 5 provides a perspective view of a coin counter typically employed in a gaming machine.
Figure 6:
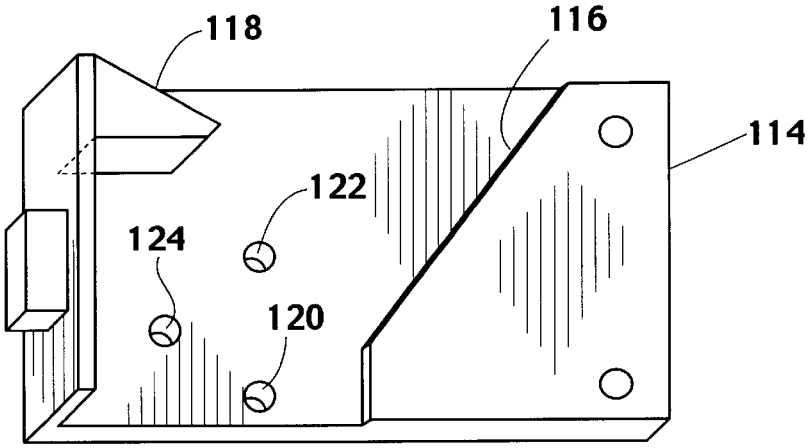
FIG. 6 provides a perspective view from the left side and front of a preferred embodiment of the inventive anti-cheating coin director.
Figure 7:
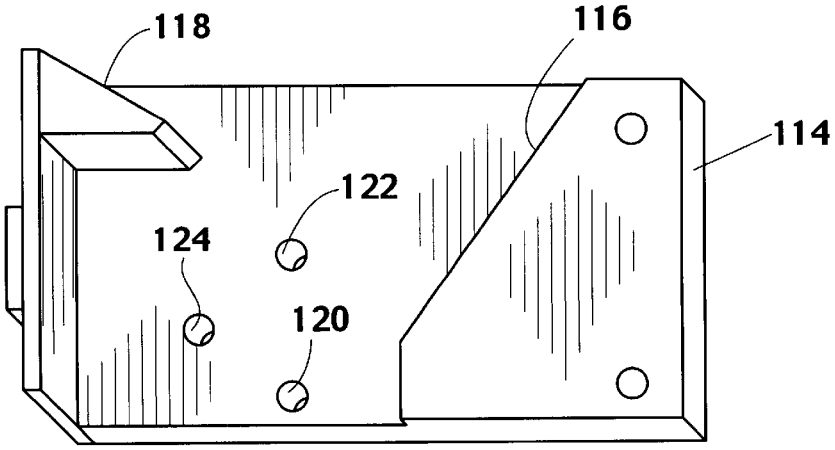
FIG. 7 provides a perspective view from the right side and front of a preferred embodiment of the inventive anti-cheating coin director.

Referring to FIG. 5, coin counter 108 includes emitter board 110, detector board 112 and coin director 114. As best seen in FIGS. 6 and 7, the inventive coin director 114 includes first coin guide 118 and second coin guide 116. Light emitting diodes located on emitter board 110 are positioned to shine through apertures 120, 122, and 124 to strike corresponding detectors on detector board 112. It should be noted that, most preferably, guide 118 protrudes to obstruct access to aperture 124 by elongated objects such that cheating tools cannot be inserted to reach aperture 124.

Figure 8:
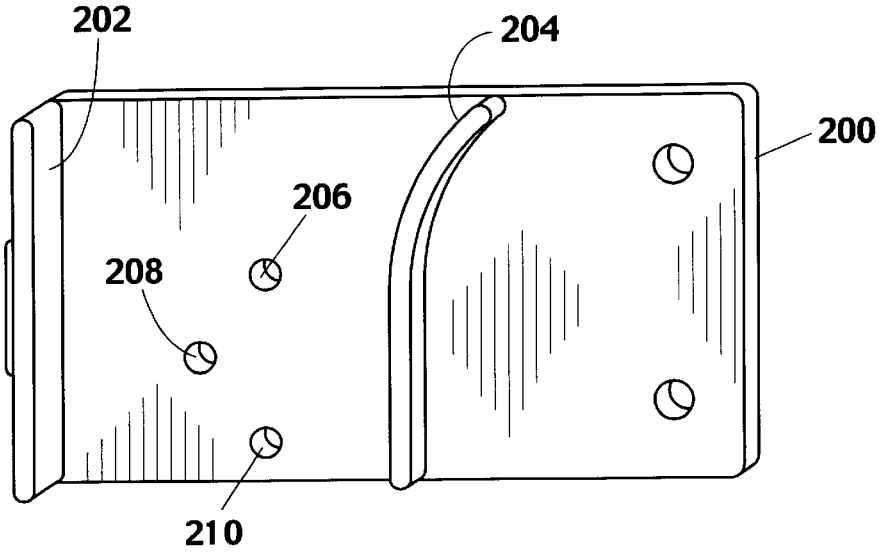
Fig. 8 ( PRIOR ART )
FIG. 8 provides a front view of a prior art coin director typically employed in a coin counter.

A better understanding of the invention can be gained by comparing the prior art coin director 200 as shown in FIG. 8. Coin guides 202 and 204 are positioned, as in the present invention to direct a coin to pass sequentially over apertures 206, 208, and 210. However, coin director 200 is constructed such that a coin may fall through coin director 200 without striking either guide 202 or 204. FIG. 4 shows a coin handler 100 with the coin counter 108 removed and an elongated of plastic tool 130 inserted in the coin path in the same manner as a cheating tool would be inserted. With the coin counter 108 removed, it can be seen that, with prior art coin director 200, such a tool can gain access to all three apertures 206, 208, and 210. Light emitting diodes properly located on tool 130 could be manipulated appropriately to, in turn manipulate the detectors on detector board 112.

With the inventive coin director in place, such a tool would strike guide 118 such that the tool could not be inserted to sufficient depth to gain access to apertures 120, 122, and 124. A tool which could be inserted past guide 118 could not gain access to aperture 124 and therefore could not be used to manipulate the coin counter 108.

Figure 9:
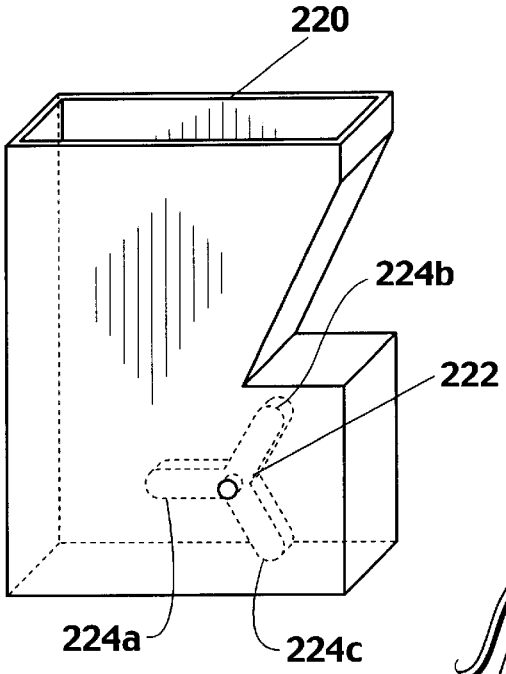
FIG. 9 provides a perspective view of another preferred embodiment of the inventive anti-cheating coin director.

In another preferred embodiment of the inventive coin director, as shown in FIG. 9, anti-cheating device 220 is placed between coin comparator 102 (FIG. 3) and coin counter 108. An inserted coin must rotate gate 222 to gain access to the coin counter 108. It should be noted that gate 222 includes a plurality of arms 224*a–c*, preferably three as shown. If an object larger than a coin is inserted, the rotation of arm 224*a*, for example, will cause arm 24*b* to hit the inserted object, thereby stopping further rotation of gate 222 and preventing further insertion of the object.

Figure 10:
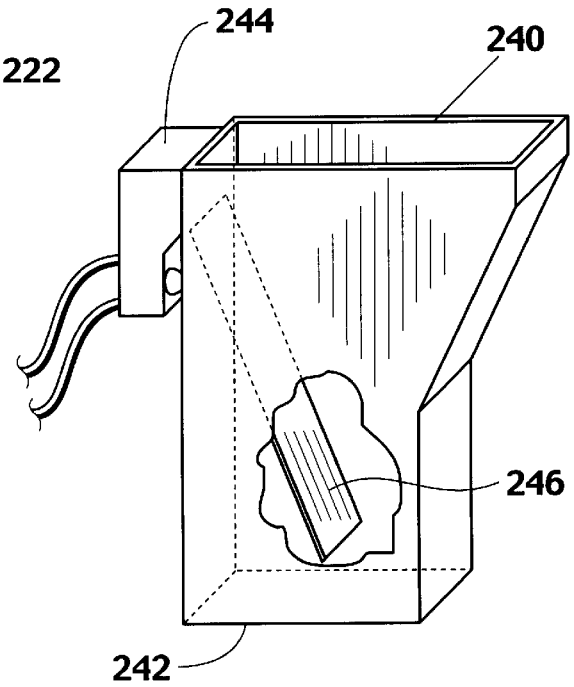
FIG. 10 provides a perspective view of yet another preferred embodiment of the inventive anti cheating coin director.

In yet another embodiment of the inventive coin director, as shown in FIG. 10, an electrical switch 244 is affixed to anti-cheating device 240 such that a coin passing through path 242 will strike actuator 246 to actuate switch 244. A coin passing through the path will cause switch 244 to produce a pulse of relatively short duration. A cheating device, on the other hand, will cause switch 244 to produce a continuous output. Electronic circuitry could be used to distinguish between a coin and an improper object in the coin path. An object which produced a pulse of too long duration would cause the machine to "tilt" thereby disabling further operation of the machine until reset by an employee of the casino.

It will be apparent to those skilled in the art that the inventive device is not limited to the embodiments discussed hereinabove, the inventive aspect being the prevention or detection of the placement of an elongated object into the machine through the coin slot.

Figure 12:
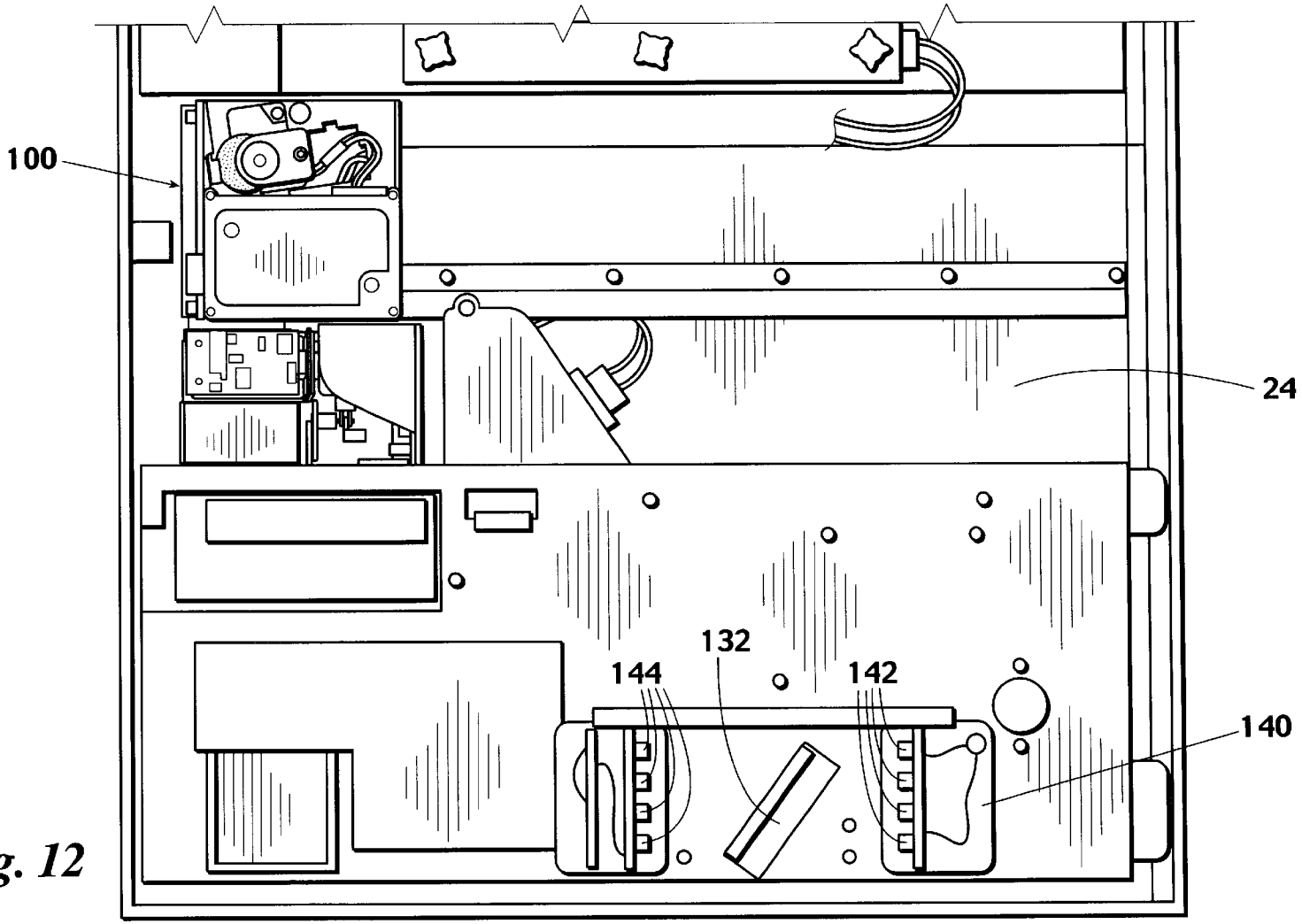
FIG. 12 provides a rear view of a preferred embodiment of an emitter/detector assembly incorporated in the inventive anti-cheating device.
Figure 13:
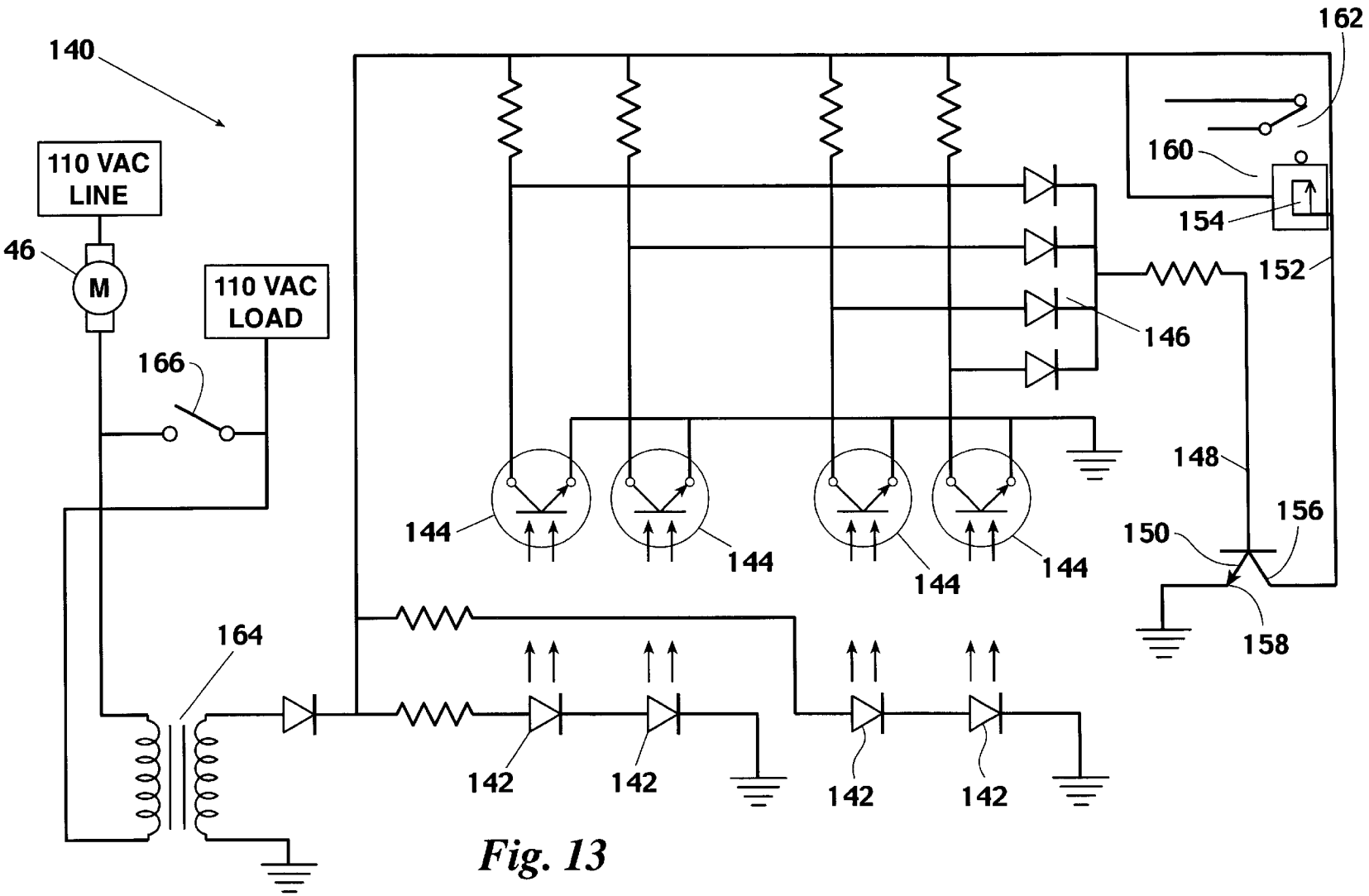
FIG. 13 provides an electrical schematic diagram of the emitter/detector assembly incorporated in the inventive anti-cheating device.

In still another preferred embodiment, as shown in FIG. 12, an emitter/detector assembly 140 is located adjacent coin chute 132 in door 24 to detect the presence of an object in the coin path for coins discharged from the machine. As discussed herein above, when the user chooses to cash out, the electronic circuit board 44 (FIG. 2) causes the coin feeder 42 (FIG. 11) to discharge the appropriate number of coins through the coin chute 132. A detector sends a signal to circuit board 44 for each coin exiting feeder 42. In a known method of cheating, a cheating tool is used to divert coins around detector 74, or disable detector 74, such that exiting coins are not counted by circuit board 44. To detect the presence of such a cheating tool, preferably emitter/detector assembly 140 includes a plurality of light emitting diodes 142 (4 shown) which emit light for reception by a plurality of photo detectors 144 (4 shown). As seen in the schematic diagram, FIG. 13, if one or more beams of light are broken, the affected detector 144 will produce a high signal. The outputs of all of the detectors are routed to a diode "OR" gate 146 such that a high output from one or more detectors will activate the base 148 of transistor 150 causing transistor 150 to turn on. Terminal 152 of relay 154 is connected to the collector 156 of transistor 150 and the emitter 158 is connected to ground such that, when transistor 150 is turned on, coil 160 of relay 154 will be energized, thereby opening normally closed contacts 162. Contacts 162 may be used to tilt the machine, disable the coin feeder, etc.

While contacts 162 are preferably normally closed, it will be apparent to those skilled in the art that normally open contacts, closed by activation of coil 160 are equally suitable.

To prevent nuisance activation of the circuit while coins are fed from the machine, transformer 164 is wired in series with feeder motor 46 such that when feeder motor 46 is not operational, a small electrical current will flow through feeder motor 46 and transformer 164 to power emitter/detector assembly 140. When feeder motor 46 is activated, electrical current flows instead through contacts 166, diverting current from emitter/detector assembly 140 and preventing the closing of contacts 162. Thus, emitter/detector assembly will automatically generate a contact closure upon the detection of a cheating device, but not upon the legitimate discharging of coins.

As will be understood by those skilled in the art that, while the above emitter/detector assembly has been discussed with reference to light emitting diodes and photodetectors, the invention is not so limited. Any type of energy beam emitter could be used in conjunction with a suitable receiver or detector to achieve the desired results. In addition, it will be understood by those skilled in the art that such an energy beam could be modulated to reduce the likelihood that a cheating device could produce a counterfeit signal to defeat the ant-cheating device.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention.

What is claimed is:

1. A gaming machine including a coin dispensing chute possessing a passageway, a coin hopper/feeder assembly for discharging coins into said passageway of said coin dispensing chute, and a feeder motor for selectively activating said coin hopper/feeder assembly to discharge coins into said passageway of said coin dispensing chute, the improvement comprising:

a radiation emitter/detector assembly for causing at least one beam of radiation to extend across said passageway of said coin dispensing chute and for detecting when said at least one radiation beam is interrupted; and means for disabling said radiation emitter/detector assembly substantially when said feeder motor activates said coin hopper/feeder assembly to discharge coins into said passageway of said coin dispensing chute.

2. A gaming machine according to claim 1, further comprising means for disabling said gaming machine when said radiation emitter/detector assembly detects that said at least one radiation beam has been interrupted and when said radiation emitter/detector assembly disabling means has not disabled said radiation emitter/detector assembly.

3. A gaming machine according to claim 2, further including a selectively operable door provided with an aperture substantially aligned with said chute passageway and further including a coin tray, such that coins discharged from said coin hopper/feeder assembly may pass through said chute passageway, through said door aperture, and into said coin tray, and wherein said radiation emitter/detector assembly is mounted on said door.

4. A gaming machine according to claim 1, further including a selectively operable door provided with an aperture substantially aligned with said chute passageway and further including a coin tray, such that coins discharged from said coin hopper/feeder assembly may pass through said chute passageway, through said door aperture, and into said coin tray, and wherein said radiation emitter/detector assembly is mounted on said door.

5. A gaming machine including:

means for selectively dispensing coins into and through a passageway to the exterior of said machine; and means for detecting the presence of an object inserted into said passageway substantially only at times other than when said dispensing means dispenses coins into and through said passageway.

6. A gaming machine according to claim 5, wherein said detecting means comprises a radiation emitter/detector assembly for causing at least one beam of radiation to extend across said passageway.

7. A gaming machine according to claim 6, wherein said radiation emitter/detector assembly is mounted on said door.

8. A gaming machine according to claim 5, further including a selectively openable door provided with an aperture substantially aligned with said passageway and wherein said detecting means detects the presence of an object inserted through said aperture and into said passageway.

9. A gaming machine according to claim 8, wherein said detecting means comprises a radiation emitter/detector assembly for causing at least one beam of radiation to extend across said passageway.

10. A gaming machine according to claim 9, wherein said radiation emitter/detector assembly is mounted on said door.

11. A gaming machine including a coin dispensing chute possessing a passageway, a coin hopper/feeder assembly for discharging coins into said chute passageway, and a feeder motor for selectively activating said coin hopper/feeder assembly to discharge coins into said chute passageway, the improvement comprising:

means for detecting the presence of an object inserted into said passageway; and means for disabling said detecting means substantially when said feeder motor activates said coin hopper/feeder assembly to discharge coins into said chute passageway.

12. A gaming machine according to claim 11, wherein said detecting means comprises a radiation emitter/detector assembly for causing at least one beam of radiation to extend across said passageway.

13. A gaming machine according to claim 12, wherein said radiation emitter/detector assembly is mounted on said door.

14. A gaming machine according to claim 11, further including a selectively openable door provided with an aperture substantially aligned with said passageway and wherein said detecting means detects the presence of an object inserted through said aperture and into said passageway.

15. A gaming machine according to claim 14, wherein said detecting means comprises a radiation emitter/detector assembly for causing at least one beam of radiation to extend across said passageway.

16. A gaming machine according to claim 15, wherein said radiation emitter/detector assembly is mounted on said door.

17. A gaming machine including:

means for selectively dispensing coins into and through a passageway to the exterior of said machine; and means for detecting the presence of a cheating tool inserted into said passageway while substantially not detecting the presence of coins dispensed by said dispensing means into and through said passageway.

18. A gaming machine according to claim 17, wherein said detecting means comprises a radiation emitter/detector assembly for causing at least one beam of radiation to extend across said passageway and for detecting when said at least one beam is interrupted.

19. A gaming machine according to claim 17, further including a selectively openable door provided with an aperture substantially aligned with said passageway and wherein said detecting means detects the presence of a cheating tool inserted through said aperture and into said passageway.

20. A gaming machine according to claim 19, wherein said radiation emitter/detector assembly is mounted on said door.

* * * * *